US010473398B2

(12) United States Patent
Decker et al.

(10) Patent No.: US 10,473,398 B2
(45) Date of Patent: Nov. 12, 2019

(54) MODULAR FURNACE, IN PARTICULAR FOR THE OXIDATIVE STABILIZATION OF A CARBON FIBER STARTING MATERIAL

(71) Applicants: CLARIANT INTERNATIONAL LTD., Muttenz (CH); LINN HIGH THERM GMBH, Eschfelden (DE)

(72) Inventors: Daniel Decker, Liederbach (DE); Michael Wölki, Frankfurt am Main (DE); Phillip Schwerdt, Mainz-Kastel (DE); Horst Linn, Eschenfelden (DE); Rudolf Linn, Hersbruck (DE); Jürgen Kunstmann, Bad Soden (DE)

(73) Assignee: Ciariant International Ltd, Muttenz (CH)

( * ) Notice: Subject to any disclaimer, the term of this patent is extended or adjusted under 35 U.S.C. 154(b) by 0 days.

(21) Appl. No.: 15/547,759

(22) PCT Filed: Jan. 26, 2016

(86) PCT No.: PCT/EP2016/051507
§ 371 (c)(1),
(2) Date: Jul. 31, 2017

(87) PCT Pub. No.: WO2016/128209
PCT Pub. Date: Aug. 18, 2016

(65) Prior Publication Data

US 2018/0031321 A1 Feb. 1, 2018

(30) Foreign Application Priority Data

Feb. 9, 2015 (DE) ..... 10 2015 001 489

(51) Int. Cl.
*F26B 13/00* (2006.01)
*F27B 9/28* (2006.01)
(Continued)

(52) U.S. Cl.
CPC ..... *F27B 9/28* (2013.01); *D01F 9/32* (2013.01); *D02J 13/005* (2013.01);
(Continued)

(58) Field of Classification Search
CPC ..... F26B 13/00; F26B 13/007; F26B 13/001; F26B 5/047; F26B 13/06; F26B 15/24;
(Continued)

(56) References Cited

U.S. PATENT DOCUMENTS 4,069,297 A 1/1978 Saito et al.
4,186,179 A 1/1980 Katsuki et al.
(Continued)

FOREIGN PATENT DOCUMENTS

EP 2534286 12/2012
JP S5988918 5/1984
WO WO 2011/098215 8/2011

OTHER PUBLICATIONS

International Search Report for PCT/EP2016/051507, dated Apr. 22, 2016.
(Continued)

*Primary Examiner* — Gregory A Wilson
(74) *Attorney, Agent, or Firm* — Tod A. Waldrop

(57) ABSTRACT

A modular furnace, in particular for the oxidative stabilization of a carbon fiber starting material comprising a cuboidal furnace chamber, on the upper face of which first deflecting rollers are arranged in a mutually spaced and parallel manner and on the lower face of which second deflecting rollers are arranged in a mutually spaced and parallel manner such that the carbon fiber starting material runs upwards and downwards in a laterally adjacent and slightly spaced manner so as to meander vertically in the area of the furnace chamber. A carbon fiber inlet locking device and a carbon fiber outlet locking device are provided on the upper face of
(Continued)

the furnace chamber, and an air guiding device is connected to the furnace chamber. A supply air portion of the air guiding device is connected to a vertical air inlet side of the furnace chamber, and a discharge air portion of the air guiding device is fluidically connected to a furnace chamber vertical air outlet side opposite the vertical air inlet side. The air guiding device has an air drive device between the supply air portion and the discharge air portion.

14 Claims, 2 Drawing Sheets

(51) Int. Cl.

| | |
|---|---|
| ***F26B 13/06*** | (2006.01) |
| ***D02J 13/00*** | (2006.01) |
| ***F27B 9/30*** | (2006.01) |
| ***F27D 5/00*** | (2006.01) |
| ***F27D 7/00*** | (2006.01) |
| ***D01F 9/32*** | (2006.01) |

(52) U.S. Cl.
CPC ..... *F27B 9/3005* (2013.01); *F27D 5/00* (2013.01); *F27D 7/00* (2013.01)

(58) Field of Classification Search
CPC .... F26B 17/08; F26B 17/105; F26B 17/1433; F26B 13/10; F27B 9/243; F27B 9/28; F27B 2009/2438; C21D 9/52; C21D 9/54; C21D 9/56
See application file for complete search history.

(56) References Cited

U.S. PATENT DOCUMENTS

| | | | | |
|---|---|---|---|---|
| 4,559,010 | A * | 12/1985 | Katsuki | D01F 9/225 432/59 |
| 5,142,796 | A * | 9/1992 | Anzai | D01F 9/145 34/62 |
| 6,027,337 | A | 2/2000 | Rogers et al. | |
| 9,157,679 | B2 * | 10/2015 | Kaji | D01F 9/32 |
| 9,528,760 | B2 * | 12/2016 | Maehara | B01D 67/0016 |
| 9,702,623 | B2 * | 7/2017 | Shinada | B01D 67/0095 |
| 2001/0033035 | A1 | 10/2001 | Panter et al. | |
| 2012/0304479 | A1 | 12/2012 | Berner | |
| 2017/0073846 | A1 | 3/2017 | Decker et al. | |

OTHER PUBLICATIONS

International Preliminary Report on Patentability for PCT/EP2016/051507, dated Aug. 15, 2017.
Machine Translation of JPS5988918, dated May 23, 1984.

* cited by examiner

MODULAR FURNACE, IN PARTICULAR FOR THE OXIDATIVE STABILIZATION OF A CARBON FIBER STARTING MATERIAL

Modular furnace, in particular for the oxidative stabilization of a carbon fiber starting material The invention relates to a modular furnace, in particular for the oxidative stabilization of carbon thread starting material, having a rectangular-block shaped furnace chamber which has first and second deflection rollers about which the carbon thread starting material is deflected in a meandering manner in the furnace chamber.

An oxidation furnace of this type is known from EP 2 534 286 B1, for example. This known oxidation furnace has a furnace chamber which, apart from inlet and outlet regions for the carbon thread starting material, is gas-tight. Hot air is blown into the process space that is located in the furnace space of the furnace chamber by means of a blower installation. A suction installation which suctions the hot air from the process space and which comprises a number of suction boxes that are disposed at a mutual vertical spacing is disposed on an end region of the process space, said suction installation having at least one outlet opening for the hot air and on one side having at least one inlet opening for the hot air, said inlet opening communicating with the process space. At least one fan recirculates the hot air through the blower installation, the process space, and the suction installation. A heating installation is located in the flow path of the hot recirculated air. Deflection rollers guide the carbon thread starting material in a meandering manner through the intermediate spaces between suction boxes that lie on top of one another.

In the case of this known oxidation furnace, the carbon thread starting material runs in a meandering manner in the horizontal direction such that gravitation-related sagging of the carbon thread starting material in the furnace space of the furnace chamber of the oxidation furnace is avoidable only by way of a corresponding effort. A further shortcoming of this known oxidation furnace lies in that the hot air perfuses the furnace chamber in the direction of the carbon thread starting material, that is in a manner parallel with the latter, such that the homogeneity of the incident flow to the carbon thread starting material by way of the hot air is open to improvement. The carbon thread starting material in the furnace space is thus not reliability imparted the same treatment.

U.S. Pat. No. 4,186,179 A discloses a furnace, in particular for the oxidative stabilization of carbon thread starting material, having a rectangular-block shaped furnace chamber in which first and second deflection rollers in pairs are disposed so as to be spaced-apart and mutually parallel in such a manner that the carbon thread starting material that is deflected about the deflection rollers runs in a meandering vertical up and down manner in the furnace space of the furnace chamber. In the case of this known oxidation furnace, the deflection rollers that are provided in pairs are disposed sequentially in an axially offset manner, wherein the run-out end of the carbon thread starting material of the respective one deflection roller pair and the run-in end of the deflection roller pair that follows in the advancing direction of the carbon thread starting material adjoin one another in a rectilinear manner. A single thread of the carbon thread starting material is directed into this known oxidation furnace and after the oxidative stabilization is directed out of the furnace space of the furnace chamber. The shortcoming that the furnace space in the axial spatial direction of the deflection roller pairs has to be dimensioned so as to be correspondingly wide arises on account of the axial lateral offset of the successive deflection roller pairs, A further shortcoming lies in that only a single thread of the carbon thread starting material is directed through the furnace chamber, this having an effect on productivity. Sagging of the carbon thread starting material in the furnace chamber is avoided on account of the vertical arrangement of the first and of the second deflection rollers of the respective deflection roller pair.

A furnace for the oxidative stabilization of a carbon thread starting material, having a rectangular-block shaped furnace chamber, is also known from U.S. Pat. No. 4,559,010 A. In the case of this known oxidation furnace, first deflection rollers are located on the upper side of the furnace chamber so as to be in the interior of the latter. Second deflection rollers are located outside the furnace chamber so as to be on the lower side of the latter. The carbon thread starting material is disposed so as to run about the first and the second deflection rollers in a slightly spaced apart manner so as to be side-by-side and in a meandering vertical up and down manner. In the case of this known oxidation furnace, the incident flow of hot air to the carbon thread starting material in the furnace chamber is performed in the direction of the carbon thread starting material, that is to say in parallel with the latter. As in the case of the oxidation furnace according to EP 2 534 286 B1 as has been described above, this is open to improvement in terms of the hot-air treatment for the oxidative stabilization of the carbon thread starting material.

A furnace, in particular for the oxidative stabilization of carbon thread starting material, having a rectangular-block shaped furnace chamber, is known from U.S. Pat. No. 6,027,337 A. The furnace chamber is assigned first and second deflection rollers which are disposed so as to be mutually spaced apart and mutually parallel in such a manner that the carbon thread starting material in the furnace space of the furnace chamber runs side-by-side and slightly mutually spaced apart in a meandering manner. In the case of this known oxidation furnace, the carbon thread starting material runs in the horizontal direction, as in the case of the above-mentioned EP 2 534 286 B1, such that gravity-related sagging of the carbon thread starting material cannot be reliably excluded.

US 2001/0033035 A1 discloses a furnace for the oxidative stabilization of carbon thread starting material which is directed through the furnace space of the furnace chamber in the horizontal direction. A distributor installation is provided in the furnace space of the furnace chamber, in order for the hot air that is directed into the furnace space to be homogenized.

The invention is based on the object of achieving a modular furnace, in particular for the oxidative stabilization of carbon thread starting material, wherein a homogenous and optimal incident flow to the carbon thread starting material in the furnace space of the furnace chamber is guaranteed in a manner that in terms of construction is simple such that each thread of the carbon thread starting material along the entire length thereof in the furnace chamber is imparted the same treatment.

This object is achieved according to the invention by the features of claim 1, that is to say by a modular furnace, in particular for the oxidative stabilization of carbon thread starting material, having a rectangular-block shaped furnace chamber, first deflection rollers being disposed so as to be mutually spaced apart and mutually parallel on the upper side of said furnace chamber, and second deflection rollers being disposed so as to be mutually spaced apart and mutually parallel on the lower side of said furnace chamber in such a manner that the carbon thread starting material in the furnace space of the furnace chamber runs side-by-side and mutually slightly spaced apart in a meandering vertical up-and-down manner, a carbon thread entry lock installation and a carbon thread exit lock installation being provided on the upper side of the furnace chamber, an air guiding installation which by way of an intake air portion is connected to a vertical air entry side of the furnace chamber and by way of an exhaust air portion is connected in fluidic terms to a vertical air exit side of the furnace chamber that is opposite the vertical air entry side being connected to the furnace chamber and the air guiding installation having an air driving installation between the intake air portion and the exhaust air portion.

The modular furnace according to the invention has the advantage that a high packing density of the threads in the furnace space is guaranteed on account of a number of threads of the carbon thread starting material being simultaneously oxidized in the furnace chamber, wherein the carbon thread starting material is moved side-by-side and slightly spaced apart in a meandering vertical up and down manner. A higher energy efficiency as compared to known furnace modules results therefrom. Likewise, sagging of the carbon thread starting material in the furnace space of the furnace chamber is prevented. A particular advantage of the modular furnace according to the invention lies in that the number of threads of the carbon thread starting material that are to be oxidatively stabilized are simultaneously exposed to a perpendicular incident flow by way of the hot air in the furnace chamber. This results in the advantage of a homogenous perpendicular incident flow to the threads of the carbon thread starting material, wherein each thread along the thread length thereof in the furnace chamber is imparted the same oxidative treatment. Moreover, a high rate of air exchange is implementable in the furnace chamber. On account of the advancing movement of the carbon thread starting material through the furnace space of the furnace chamber being performed on only two planes, specifically by means of the first deflection rollers that are provided on the upper side of the furnace chamber and by means of the second deflection rollers that are provided on the lower side of the furnace chamber, simple threading of the multiplicity of threads, for example 48 threads, of the carbon thread starting material into the modular furnace results from the meandering vertical running path of said threads. This means easy operability of the modular furnace according to the invention.

On account of the modular construction mode, the further advantage that a dedicated chassis is implementable for each temperature stage for carrying out the oxidative stabilization of carbon thread starting material results, such that complete de-linking of individual oxidative stabilization stages is possible in a space-saving and simple constructive manner.

It is preferable for each first and/or second deflection roller to be connected to a dedicated drive installation, such that the deflection rollers can be driven in a mutually independent manner, even at different revolutions, in order for the thread tension of the threads of the carbon thread starting material in the furnace space of the furnace chamber to be able to be set in the desired manner.

It has proven advantageous for a lid space in which the first deflection rollers are located to be attached to the upper side of the furnace chamber, for a base space in which the second deflection rollers are located to be attached to the lower side of the furnace space, and for the lid space to have the carbon thread entry lock installation and the carbon thread exit lock installation.

On account of a configuration of this type, the advantage results that the furnace chamber is as it were free of installed appliances such that all equipment components such as the air driving installation of the air guiding installation or the like are readily accessible from outside the modular furnace without the furnace chamber having to be opened. This is advantageous from the point of view of repairs, for example.

It has proven particularly advantageous for a screen installation to be assigned to the vertical air entry side of the furnace chamber and/or to the vertical air exit side of the furnace chamber. The screen installation serves in particular for homogenizing the hot air stream in the furnace chamber such that a homogenous perpendicular incident flow to the carbon thread starting material by way of the hot air is guaranteed in the furnace chamber, and each thread or thread portion, respectively, in the furnace chamber is imparted the same thermal treatment. It has been surprisingly demonstrated herein that a material of the screen installation that has a particularly fine mesh has the effect of a high degree of homogenization of the flow velocity of the air stream. Moreover, the screen installation is preferably configured as a particle retention installation such that filament fragments of the carbon thread starting material are retained in the screen installation and a fire risk by way of PAN fragments impacting and/or accumulating on the heating elements is eliminated. A fire-extinguishing installation such as is described in the case of the oxidation furnace according to U.S. Pat. No. 4,559,010 A as cited at the outset is advantageously dispensable in the case of the modular furnace according to the invention.

In the case of the modular furnace according to the invention, the air driving installation preferably has at least one cross-flow fan, because such a cross-flow fan, as opposed to a radial or an axial fan, generates a homogenous air stream field.

The at least one cross-flow fan in the case of the modular furnace according to the invention is preferably connected to a diffusor which forms a part-portion of the intake air portion of the air guiding installation. In this way, a quasi-isobaric air stream is provided downstream of the at least one cross-flow fan, that is to say that undesirable air turbulences are avoided.

A substantial feature of the modular furnace according to the invention lies in that the hot oxidation air with the aid of the air guiding installation recirculates in a closed circuit, so to speak, and the carbon thread starting material that in the furnace space is moving in a meandering vertical up and down manner herein is exposed to a homogenous perpendicular incident flow such that each longitudinal portion of the carbon thread starting material in the furnace chamber is advantageously imparted the same oxidation treatment.

The intake air portion and the exhaust air portion of the air guiding installation herein can in each case be configured so as to be bent, and flat air directing elements can be provided in the region of the bend. Optimized hot air guiding in the air guiding installation of the modular furnace according to the invention and a rectilinear, quasi-laminary air stream in the furnace chamber result in this way; undesirable cross-mixing in the furnace chamber is advantageously reduced to a minimum.

It is preferable for an air exchange installation which has a fresh air inlet and an exhaust air outlet to be provided in the exhaust air portion of the air guiding installation, and for at least one gas sensor which is operatively connected, that is to say operatively linked, to the fresh air inlet and to the exhaust air outlet of the air exchange installation to be provided in the exhaust air portion. The same purpose can be served when an air exchange installation which has a fresh air inlet and an exhaust air outlet is provided in the intake air portion of the air guiding installation, and when at least one gas sensor which is operatively connected, that to say operatively linked, to the fresh air inlet and to the exhaust air outlet of the air exchange installation is provided in the intake air portion.

On account thereof, regulating the oxygen content or the pollutant content, respectively, is possible in the furnace space of the furnace chamber such that it is achievable for the exhaust air quantity that is generated to be minimized. This is advantageous from an energy and an environmental point of view.

Optimal regulating of the modular furnace according to the invention is possible when at least one flow rate sensor is provided in the intake air portion and/or in the exhaust air portion of the air guiding installation. The at least one flow rate sensor, like the at least one gas sensor that is provided in the exhaust air portion and/or in the intake air portion, is operatively linked to the associated air exchange installation.

In order for the hot air that serves for the oxidative stabilization of the carbon thread starting material to be generated, a heating installation is advantageously provided in the intake air portion of the air guiding installation. The heating installation herein is preferably provided downstream of the diffusor of the air guiding installation and upstream of the screen installation.

It is particularly advantageous for the heating installation as a zonal heating installation to have at least two heating elements which are disposed so as to be mutually spaced apart and vertically on top of one another. Separate patent protection is applied for therefor.

With the aid of the zonal heating installation it is possible for an isotherm to be implemented in the furnace space of the furnace chamber such that all threads of the carbon thread starting material that are simultaneously moving in a meandering vertical up and down manner through the furnace chamber are oxidatively stabilized in the same optimal manner, that is to say are treated identically.

In order for the zonal heating installation to be regulated it is preferable for temperature sensors to be disposed vertically on top of one another so as to correspond to the vertical positions of the heating elements in a mutually spaced apart manner in the furnace space, wherein the respective at least one temperature sensor is operatively linked, that is to say connected to the associated at least one heating element.

In order for the thermal losses of the modular furnace according to the invention to be limited to a minimum, it is preferable for the modular furnace to be surrounded by a thermal insulation.

Further details, features, and advantages are derived from the description hereunder in conjunction with the appended drawings.

Figure 1:
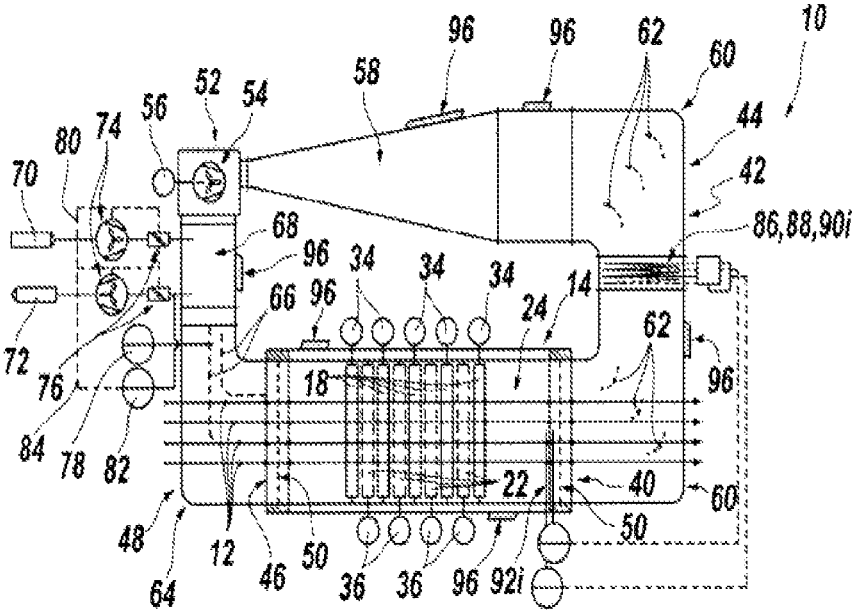
FIG. 1 shows a schematic illustration of an embodiment of the modular furnace according to the invention when viewed from above.
Figure 2:
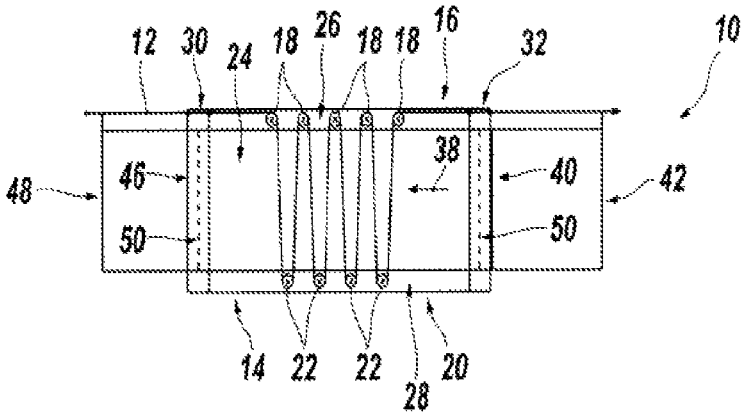
FIG. 2 shows a schematic illustration of the modular furnace according to FIG. 1 in a side view.
Figure 3:
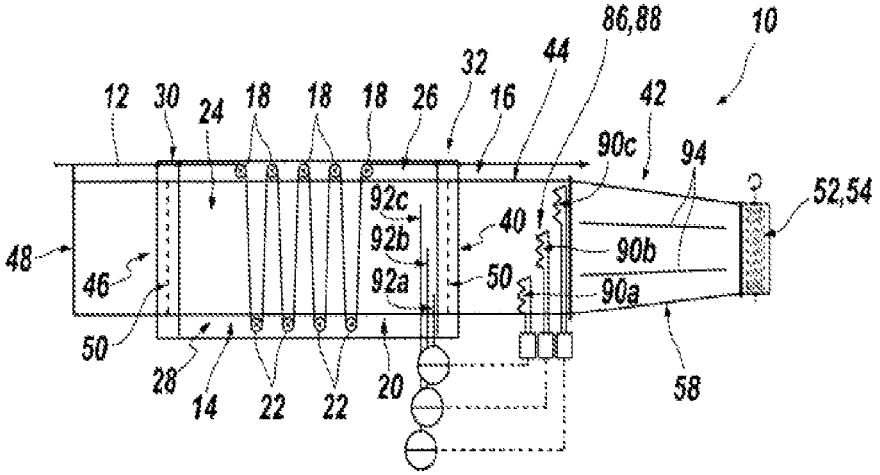
FIG. 3 shows a schematic side view, similar to that of FIG. 2, for highlighting in particular the heating installation of the modular furnace according to FIGS. 1 and 2, said heating installation being configured as a zonal heating installation.

FIGS. 1 to 3 schematically show an embodiment of the modular furnace 10 which in particular is provided for the oxidative stabilization of carbon thread starting material 12. The modular furnace 10 has a rectangular-block shaped furnace chamber 14, first deflection rollers 18 being disposed on the upper side 16 thereof so as to be mutually spaced apart and mutually parallel, and second deflection rollers 22 being disposed on the lower side 20 thereof so as to be mutually spaced apart and mutually parallel, mounted in a rotatable manner such that the carbon thread starting material 12 in the furnace space 24 of the rectangular-block shaped furnace chamber 14 run side-by-side 8 (cf. FIG. 1) and slightly spaced apart in a meandering vertical up and down manner (cf. FIG. 2).

The first deflection rollers 18 are disposed in a lid space 26 which is provided on the upper side 16 of the furnace chamber 14. A base space 28 in which the second deflection rollers 22 are located is provided on the lower side 20 of the furnace chamber 14.

The lid space 26 for the carbon thread starting material 12 that is formed from a number of threads that are provided side-by-side has a carbon thread entry lock installation 30 and a carbon thread exit lock installation 32.

Each first deflection roller 18 is connected to an associated dedicated drive installation 34, and each second deflection roller 22 is connected to an associated dedicated drive installation 36 such that it is possible for the thread tension of the threads from the carbon thread starting material 12 in the furnace space 24 of the furnace chamber 14 to be set as desired by way of targeted controlling of the drive installations 34, 36.

In order for the hot air stream (indicated by the arrow 38) in the furnace space 24 of the furnace chamber 14 to be homogenized, in each case a screen installation 50 which has the effect of homogenizing the stream of hot air in the furnace space 24 of the furnace chamber 14 is provided on the vertical air entry side 40 of the furnace chamber 14, at the downstream end of an intake air portion 42 of an air guiding installation 44 of the modular furnace 10, and on the vertical air exit side 46 of the rectangular-block shaped furnace chamber 14, at the upstream end of an exhaust air portion 48 of the air guiding installation 44. The respective screen installation 50 serves simultaneously as a particle retention installation. The respective screen installation 50 is formed by a woven mesh fabric, for example, and is provided for holding back fine particles or filament portions, respectively, of the carbon thread starting material 12 and keeping the latter away from the furnace space 24. The respective screen installation 50 is dimensioned as a braided structure, a woven fabric, or a warp-/weft-knitted fabric having a fine mesh, for example, and having a pore or mesh width of ≤500 μm.

The air guiding installation 44 between the intake air portion 42 and the exhaust air portion 48 has an air driving installation 52. The air driving installation 52 is formed by at least one cross-flow fan 54 which is connected to a drive motor 56.

The at least one cross-flow fan 54 in fluidic terms is connected to an associated diffusor 58 which forms a part-portion of the intake air portion 42 of the air guiding installation 44.

As can be seen from FIG. 1, the intake air portion 42 of the air guiding installation 44 and the exhaust air portion 48 of the latter are in each case configured so as to be bent. Sheet-metal plate shaped air directing elements 62 are provided in the region of the bend 60 of the intake air portion 42. Sheet-metal plate shaped air directing elements 66 are provided in the region of the bend 64 of the exhaust air portion 48 of the air guiding installation 44.

The air guiding elements 62, 66 are provided for deflecting in a guided manner the hot air in the region of the bends 60, 64 and, on account thereof, for avoiding as best as possible undesirable turbulences of the hot air.

An air exchange installation 68 which has a fresh air inlet 70 and an exhaust air outlet 72 is provided in the exhaust air portion 48 of the air guiding installation 44. The fresh air inlet 70 and the exhaust air outlet 72 are in each case connected to a fan 74. The respective fan 74 is assigned a flap installation 76. The flap installations 76 are connected to the air exchange installation 68.

A gas sensor 78 is operatively connected to the fans 74 and to the flap installations 76. The gas sensor 78 is provided in the exhaust air portion 48, the operative connection of said gas sensor 78 to the fans 74 and to the flap installations 76 being indicated by dash-dotted lines 80. The flap installations 76 and the associated fans 74 are suitably actuated with the aid of the gas sensor 78, so as to introduce fresh air in a defined manner into the exhaust air portion 48 and/or to discharge exhaust air that contains pollutants from the exhaust air portion 48.

A flow rate sensor which is disposed in the exhaust air portion 48 and is operatively connected to the fans 74 and to the flap installations 76 is identified by the reference sign 82. This operative connection is indicated by the dash-dotted line 84 (cf. FIG. 1).

As can be seen from FIGS. 1 and 3, a heating installation 86 is provided in the intake air portion 42 of the air guiding installation 44, in order for hot air to be generated. As can be seen from FIG. 3, the heating installation 86 is configured as a zonal heating installation 88 having heating elements 90*i*=90*a*, 90*b*, and 90*c*, which are provided vertically on top of one another so as to be mutually spaced apart. The heating elements 90*i* are operatively linked to temperature sensors 92*i*=92*a*, 92*b*, and 92*c*, in order for an isotherm to be achieved in the furnace space 24 of the rectangular-block shaped furnace chamber 14 by suitably impinging the heating elements 90*i* with energy.

FIG. 3 moreover highlights planar air directing elements 94 which are provided in the diffusor 58 and by means of which an isobaric air stream is achieved through the diffusor 58 and undesirable air turbulences are avoided.

The modular furnace 10 is provided with a thermal insulation 96 which is indicated only in portions in the figures.

All details in FIGS. 1 to 3 are in each case provided with the same reference signs such that a respective detailed description of all details in conjunction with all figures can be dispensed with.

LIST OF REFERENCE SIGNS

10 Modular furnace (for 12)
12 Carbon thread starting material
14 Rectangular-block shaped furnace chamber (of 10 for 12)
16 Upper side (of 14)
18 First deflection rollers (on 16 for 12)
20 Lower side (of 14)
22 Second deflection rollers (on 20 for 12)
24 Furnace space (of 14)
26 Lid space (on 16 for 18)
28 Base space (on 20 for 22)
30 Carbon thread entry lock installation (for 12 on 26)
32 Carbon thread exit lock installation (for 12 on 26)
34 First drive installation (for 18)
36 Second drive installation (for 22)
38 Arrow/hot air stream (in 24)
40 Vertical air entry side (of 14)
42 Intake air portion (of 44)
44 Air guiding installation (of 10)
46 Vertical air exit side (of 14)
48 Exhaust air portion (of 44)
50 Screen installation (on 40, 46)
52 Air driving installation (in 44 between 42 and 48)
54 Cross-flow fan (of 52)
56 Drive motor (for 54)
58 Diffusor (of 44 on 52)
60 Bend (of 42)
62 Air directing elements (at 60)
64 Bend (of 48)
66 Air directing elements (at 64)
68 Air exchange installation (in 48)
70 Fresh air inlet (of 68)
72 Exhaust air outlet (of 68)
74 Fan (of 70, 72)
76 Flap installation (for 70, 72)
78 Gas sensor (for 68)
80 Dashed line/operative connection (of 78 to 74, 76)
82 Flow rate sensor (in 68)
84 Dashed line/operative connection (of 82 to 74, 76)
86 Heating installation (of 10 in 44)
88 Zonal heating installation (of 86)
90*i* Heating elements (of 88)
92*i* Temperature sensors (for 90*i*)
94 Air directing elements (in 58)
96 Thermal insulation (of 10)

The invention claimed is:

1. A modular furnace comprising a rectangular-block shaped furnace chamber, first deflection rollers being disposed so as to be mutually spaced apart and mutually parallel on the upper side of the furnace chamber, and second deflection rollers being disposed so as to be mutually spaced apart and mutually parallel on the lower side of the furnace chamber in such a manner that the carbon thread starting material in the furnace space of the furnace chamber runs side-by-side and mutually slightly spaced apart in a meandering vertical up-and-down manner, a carbon thread entry lock installation and a carbon thread exit lock installation provided on the upper side of the furnace chamber, an air guiding installation which by way of an intake air portion is connected to a vertical air entry side of the furnace chamber and by way of an exhaust air portion is connected in fluidic terms to a vertical air exit side of the furnace chamber that is opposite the vertical air entry side being connected to the furnace chamber, and the air guiding installation having an air driving installation between the intake air portion and the exhaust air portion and wherein the modular furnace comprises an air exchange installation which has a fresh air inlet and an exhausting air outlet and in that at least one gas sensor is operatively linked to the fresh air inlet and to the exhaust air outlet of the air exchange installation which is provided in the exhaust air portion and/or in the intake air portion of the air guiding installation.

2. The modular furnace as claimed in claim 1, wherein each first and/or each second deflection roller is in each case connected to one drive installation.

3. The modular furnace as claimed in claim 1, wherein a lid space in which the first deflection rollers are located is provided on the upper side of the furnace chamber, in that a base space in which the second deflection rollers are located is provided on the lower side of the furnace space, and in that the lid space has the carbon thread entry lock installation and the carbon thread exit lock installation.

4. The modular furnace as claimed in claim 1, wherein a screen installation is provided between the vertical air entry side of the furnace chamber and the intake air portion of the air guiding installation, and/or between the vertical air exit side of the furnace chamber and the exhaust air portion of the air guiding installation.

5. The modular furnace as claimed in claim 4, wherein the screen installation is provided for homogenizing the air stream in the furnace chamber and is configured as a particle retention installation.

6. The modular furnace as claimed in claim 1, wherein the air driving installation has at least one cross-flow fan.

7. The modular furnace as claimed in claim 6, wherein the at least one cross-flow fan is connected to a diffusor which forms a part-portion of the intake air portion of the air guiding installation.

8. The modular furnace as claimed in claim 1, wherein the intake air portion and the exhaust air portion of the air guiding installation are in each case configured so as to be bent, and air directing elements are provided in the region of the respective bend.

9. The modular furnace as claimed in claim 1, wherein at least one flow rate sensor is provided in the intake air portion and/or in the exhaust air portion of the air guiding installation.

10. The modular furnace as claimed in claim 1, wherein a heating installation is provided in the intake air portion of the air guiding installation.

11. The modular furnace as claimed in claim 10, wherein the air driving installation has at least one cross-flow fan, wherein the at least one cross-flow fan is connected to a diffusor which forms a part-portion of the intake air portion of the air guiding installation and wherein the heating installation is provided downstream of the diffusor.

12. The modular furnace as claimed in claim 10, wherein the heating installation as a zonal heating installation has at least two heating elements which are disposed so as to be mutually spaced apart and vertically on top of one another.

13. The modular furnace as claimed in claim 12, wherein temperature sensors which are disposed vertically on top of one another so as to correspond to the vertical positions of the heating elements are mutually spaced apart in the furnace space, wherein the respective at least one temperature sensor is connected to the associated at least one heating element of the respective temperature zone.

14. The modular furnace as claimed in claim 1, wherein the modular furnace is surrounded by a thermal insulation.

* * * * *